United States Patent [19]

Kinzler et al.

[11] Patent Number: 4,812,209

[45] Date of Patent: Mar. 14, 1989

[54] HEADBOX FOR THE PRODUCTION OF FIBROUS STOCK WEBS

[75] Inventors: Gernot Kinzler, Heidenheim; Gerhard Layher, Königsbronn, both of Fed. Rep. of Germany

[73] Assignee: J. M. Voith GmbH, Heidenheim, Fed. Rep. of Germany

[21] Appl. No.: 18,455

[22] Filed: Feb. 25, 1987

[30] Foreign Application Priority Data

Mar. 6, 1986 [DE] Fed. Rep. of Germany ..... 3607306

[51] Int. Cl.[4] ..... D21F 1/06

[52] U.S. Cl. ..... 162/343; 162/347; 162/344; 162/345

[58] Field of Search ..... 162/347, 343, 336, 339, 162/344, 345

[56] References Cited

U.S. PATENT DOCUMENTS 2,911,039 11/1959 Hornbostel et al. .
3,943,035 3/1976 Stotz et al. .
4,141,788 2/1979 Justus .
4,181,568 1/1980 Pfaler ..... 162/343
4,349,414 9/1982 Stenberg .
4,543,162 9/1985 Hildebrand ..... 162/343

FOREIGN PATENT DOCUMENTS 2093879 of 0000 United Kingdom .

*Primary Examiner*—Peter Chin
*Assistant Examiner*—Thi Dang
*Attorney, Agent, or Firm*—Albert L. Jeffers; Richard L. Robinson

[57] ABSTRACT

A headbox, preferably for a paper machine, has a nozzle chamber with a slice gap, which is confined by a top and a bottom lip wall and by two side walls. The nozzle chamber is divided for the production of multi-layer fibrous stock webs into two or more machine-wide flow channels. For this purpose at least one wedge-shaped partition wall extends through the nozzle chamber from one side wall to the other, with this partition wall projecting through the slice gap in the direction of flow. Each of the two side walls is subdivided along the partition wall into two side wall sections. The partition wall is clamped between the side wall sections in the area of each side wall.

29 Claims, 2 Drawing Sheets

HEADBOX FOR THE PRODUCTION OF FIBROUS STOCK WEBS

The invention relates to a headbox for the production of fibrous stock webs, preferably on a paper machine, specifically with the features indicated in the definition of the preamble of claim 1. According to this, the inventionis a so-called multi-layer headbox which—for the production of a multi-layer (preferably two-layer) fibrous stock web—feeds two or more layered machine-width fibrous stock flows to the paper machine. Sheet formation takes place preferably between two rotating wire belts, that is, simultaneously or virtually simultaneously for the different layers of the fibrous stock web. Sheet formation can, however,also take place on a conventional fourdrinier section. In both cases a firm bonding between the layers of the fibrous stock web is aimed at. Nevertheless, the different layers of the fibrous stock web, e.g. top and bottom side, should be quite distinct from each other in accordance with the different raw materials and/or colours. This is achieved in that the different fibrous stock flows inside the headbox - and also for a certain distance after issuing from the headbox - are kept separate from each other.

A headbox of the type mentioned on page 1 hereof is known from U.S. Pat. No. 2,911,039. The twin-wire paper machine to which this well-known headbox belongs has one suction breast roll each on both sides of the wedge-shaped inlet nip of the twin wire section. In the area of these suction breast rolls sheet formation begins as early as in the direct area of the headbox. This kind of sheet formation is unfavourable at high machine speeds. Furthermore, the suction rolls are very expensive, both to purchase and to operate, owing to their high energy consumption for the generation of vacuum.

Other configurations are known from U.S. Pat. No. 4,141,788. In that patent the two wire belts are led over rolls and fixed supporting strips or are stretched around a forming roll with a large diameter. The headbox has—for separation of the different stock flows in the headbox and in the initial zone of sheet formation—foil-type partition walls which extend over the slice gap of the headbox. In this well-known mode of construction it is unsatisfactory that the foil-type partition walls have only a limited service life and that under certain circumstances tend to vibrate, involving the risk of a disturbance of sheet formation.

It has been attempted to avoid these drawbacks with the help of other designs. For example, in accordance with U.S. Pat. No. 4,349,414 plate-shaped partition walls are provided, which are pivoted at their inlet-side end and extend into the slice gap or a little further beyond. In a practical example such a plate-shaped partition wall has a foil-type extension at the outlet-side end. In accordance with DE-OS No. 31 07 875, rigid plates are provided in the flow channel of a multi-layer headbox as partition walls, which should be rigidly fastened in the flow channel. At the outlet-side end of each of these partition walls is connected a flexible foil.

The present invention is based on the problem of creating a multi-layer headbox on which, for separation of the stock flows, exclusively rigid constructional elements, i.e. not constructional elements which tend to vibrate, are used. If required, a facility should be available for exchanging the partition wall in order to be able to adapt its length to various requirements.

The solution to this problem is achieved according to the invention by the use of the characteric features of claim 1. Through the subdivision of the side walls of the flow channel along the partition wall (or along the partition walls) it is not only possible to fasten the partition wall (or the partition walls) rigidly into the side walls; rather this creates at the same time the prerequisite that (as per claim 2) one of the two lip walls, preferably the top lip, can be swung up with the side wall sections fastened to it, so that the partition wall—despite the rigid fastening in operation—can be exchanged. Furthermore, this creates good accessibility to the flow channel of the headbox for any cleaning. In a headbox of a different type, which serves for the formation of a single-layer fibrous stock web on a cylinder mould, the swivellability of a lip wall is already known; see CH PS No. 564 639 (=U.S. Pat. No. 3,943,035).

According to a further idea of the invention the partition wall can be subdivided into an inlet-side or upstream partition wall section (which is preferably anchored inseparably in the headbox by welding) and in an outlet-side or downstream partition wall section. In this case, only the outlet-side or downstream partition wall section is exchangeable. This facilitates exchanging because the constructional part to be exchanged is smaller. Further measures which facilitate the exchanging of the outlet-side partition wall section are indicated in claims 4 and 5. The bayonet fixing socket described therein at the same time ensures an extraordinarily rigid connection of the two partition wall sections during operation.

In the further subclaims additional advantageous configurations of the invention are described.

The drawing shows an embodiment of the invention.

Figure 4:
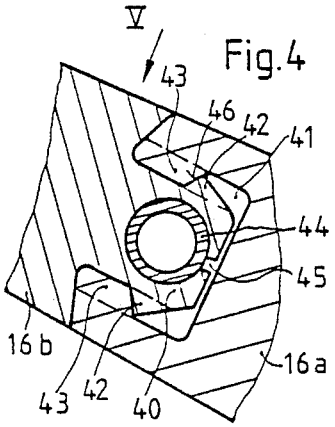
Figure 5:
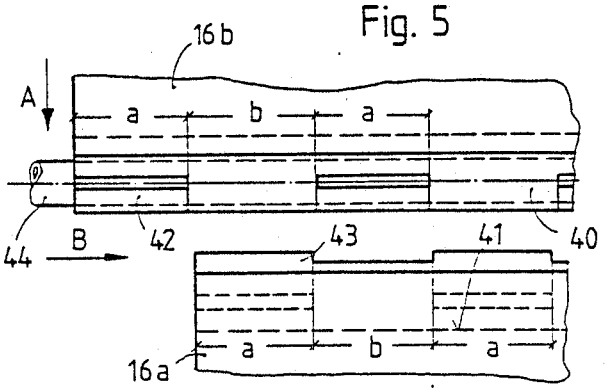

FIGS. 4 and 5 show details of the bayonet fixing socket between the two sections of the partition wall. FIG. 4 is an enlarged detail from FIG. 1 at IV; FIG. 5 shows the partition wall sections prior to joining together, in a partial view in the direction of arrow V of FIG. 4.

Figure 1:
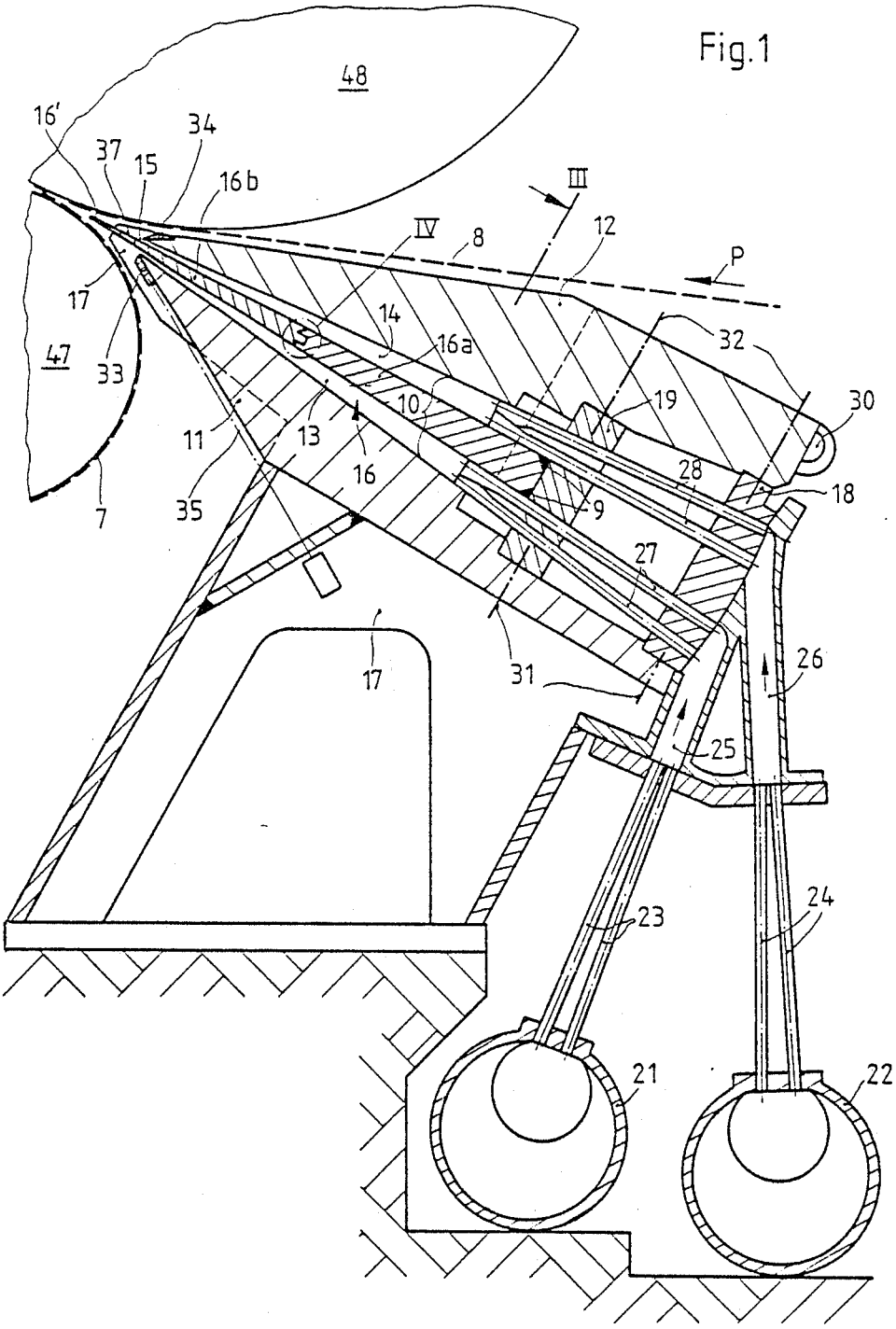
FIG. 1 shows a longitudinal section through a two-layer headbox.

The two-layer headbox shown in FIG. 1 has a bottom lip 11 and a top lip wall 12. Both lip walls are manufactured from thick solid material; they extend in the illustrated cross sectional form transversely across the width of a paper machine. The two lip walls 11 and 12 confine a machine-wide nozzle chamber, which is identified in FIG. 1 altogether with 10. The nozzle chamber tapers in the direction of flow up to slice gap 15. It is subdivided by means of an approximately wedge-shaped partition wall 16 into two machine-wide flow channels 13 and 14.

Figure 3:
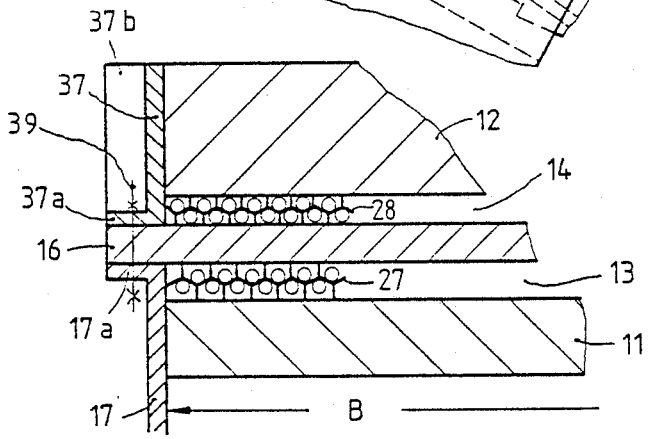
FIG. 3 shows a partial cross section along the line III of FIG. 1.

For the supply of two different fibrous suspensions are provided in a well-known way two transverse distribution pipes 21 and 22 which extend underneath the headbox in the cross machine direction. The fibrous suspensions flow from the transverse distribution pipes 21 and 22 through one bank each of evener tubes 23 and 24 respectively into one machine-wide central channel each designated 25 or 26 respectively. At the inlet into the two machine-wide turbulence tube banks 27 and 28 the stock flows are deflected into the upwardly inclined flow direction of the nozzle chamber 10. This configuration is in principle known from DE-PS No. 23 07 849 (=U.S. Pat. No. 3,945,882). The turbulence tubes 27 and 28 have, in the direction of flow, initially a circular cross section which flares in the form of a steady diffusor ahead of the outlet into the flow channels 13 and 14. In each of these steady diffusors the circular cross section changes into a pentagonal cross section; see FIG. 3.

Figure 2:
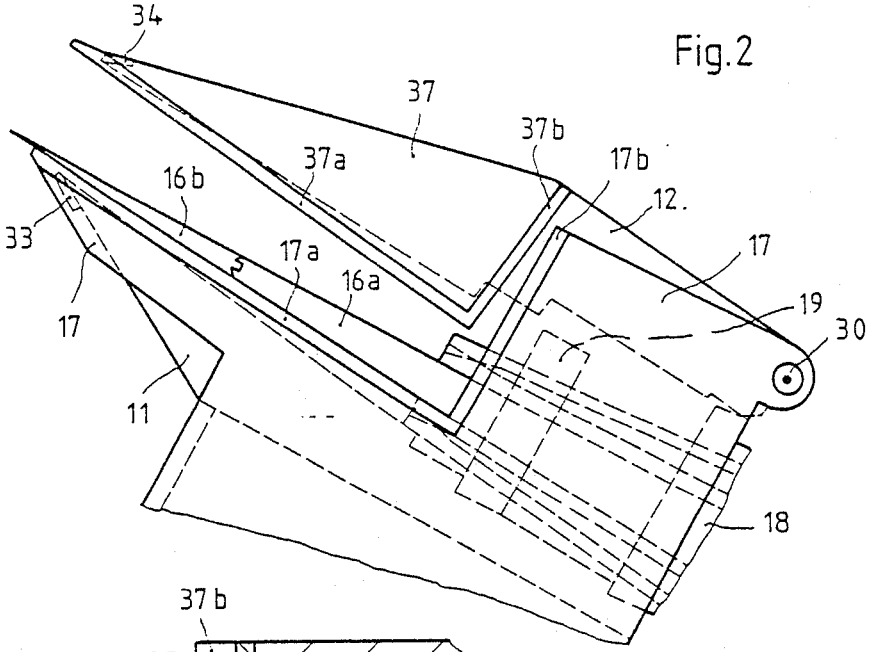
FIG. 2 shows the same headbox in a side elevation, in opened condition.

The bottom lip wall 11 is connected at both its ends, i.e. on the tending side and on the drive side of the paper machine, to two side frames 17. These at the same time form a part of the side walls of the nozzle chamber 10; see FIG. 2. the turbulence tubes 27 and 28 rest with their inlet-side or upstream ends in a machine-wide external cross wall 18, and they also rest at a certain distance from their outlet-side or downstream end in a likewise machine-wide internal cross wall 19. The partition wall 16 is subdivided into an inlet-side or upstream partition wall section **16*a*, which is rigidly connected to the internal cross wall 19, e.g. by welding, and into an outlet-side or downstream partition wall section 16*b*. The cross walls 18 and 19, with the turbulence tube banks 27 and 28 inserted therein, together form the so-called turbulence insert. On installation of the headbox, this is placed together with the inlet-side partition wall section 16*a* from above between the side walls 17 onto the bottom lip wall 11. Connection is made by means of bolts 31, which are indicated in FIG. 1 solely by their centrelines. The top lip wall 12 is likewise inserted from above between the side walls 17 and bolted to the cross walls 18 and 19 (bolts 32). Furthermore, the top lip wall 12 is connected to the two side walls 17 by means of one swivel support 30 each. Thus the top lip wall 12, as shown in FIG. 2, can be swung up after slackening of bolts 32**.

For the lateral confinement of the top flow channel 14 of the nozzle chamber 10 one side wall section 37 each is provided at either end of the top lip wall 12. In side elevation as per FIG. 2 this has approximately the form of a triangle. These two side wall sections 37 are designed as components separate from the side walls 17. In this way they can, if required, be swung up as per FIG. 2 together with the top lip wall 12. Above all, however, through this subdivision of the side walls, the partition wall 16 can be clamped in between the side wall sections 17 and 37. For this purpose, the width of the partition wall 16 over the greatest part of its length is larger than the clear width B of the flow channels 13 and 14; see FIG. 3. At the side wall sectins 17 and 37 are provided flanges **17*a* and 37*a* to which the partition wall 16 can be bolted (bolts 39). Flanges 17*b* and 37*b* running upwards at right angles to the partition wall serve esclusively for direct bolting of the two side wall sections 17 and 37**.

The partition wall sections **16*a* and 16*b* can be made of different materials. The upstream partition wall section 16*a* is preferably of steel so that it can be welded to the cross wall 19 at the points 9. The downstream partition wall section 16*b* can, to facilitate exchange, be made of, for example, reinforced material, i.e. as rigid a synthetic material as possible. If required, clamping devices can be arranged along flanges 18*a* and 37*a* with the aid of which the downstream partition wall section 16*b* can be reclamped at right angles to the direction of flow (after slackening of bolts 39**), if necessary using the mentioned reinforcement.

It is self-evident that the surfaces of the entire partition wall 16 coming into contact with the flow must be absolutely smooth to prevent the creation of non-uniform turbulence and the clinging of fibres. At the connection point 9 with the cross wall 19 the partition wall is fairly thick; it tapers from here in the direction of flow uniformly up to the end 16' projecting beyond the slice gap 15. The angle of taper of the partition wall 16 can be constant over its entire length.

Instead, however, provision can also be made for the angle of taper to be somewhat smaller in the area of the slice gap 15 than in the other area of the nozzle chamber 10. Although, in this way, the directions of flow of the two stock jets are not yet precisely parallel to each other when leaving the headbox, the deviation of the parallelism is only slight.

The two partition wall sections **16*a* and 16*b* are connected to each other by a special bayonet fixing socket. The connection should be rigid and at the same time so tightly sealed along the joint that a clinging of fibres is ruled out. For this purpose a bar 40 is moulded onto one (e.g. onto the outlet-side) partition wall section 16b, with this bar 40 projecting into a slot 41 of the other partition wall section 16*a*; see FIG. 4. Onto the lateral surfaces of the bar 40 are moulded lugs 42; these are surrounded, as in pliers, by lugs 43 which are moulded onto the lateral internal walls of slot 41. At both partition wall sections 16*a* and 16*b* are arranged along the joint several lugs 42 and 43 of the said type. They all have a well-defined length a; between them there are interstices of the length b, which is somewhat larger than the length a. In this way the partition wall sections, starting from the position shown in FIG. 5, can be connected to each other in that the outlet-side partition wall section 16*b* is initially pushed in the direction of the arrow A until the bar 40 is introduced into the slot 41. Following this, the partition wall section 16*b* is pushed in the direction of the arrow B, i.e. along the joint, so that the lugs 42 and 43 engage in each other. In the bar 40 is inserted a hydraulic tube 44; it also has a slit 45 at its face end. The tube 44 can be expanded by the supply of a pressure means so that the lugs 42 are spread out. In this way and through the inclined arrangement of the contacting surfaces 46 of the lugs 42 and 43 the outlet-side partition wall section 16*b* is rigidly clamped to the inlet-side partition wall section 16*a***.

For microadjustment of the slice gap 15 (more precisely: the two slice gaps) one profile bar 33 and 34 each is arranged at the two lip walls 11 and 12. The profile bar 34 provided at the top lip 12 is rigidly bolted to the top lip. If required, it can be exchanged for another one of a different size. The profile bar 33 arranged at the bottom lip 11 is, in a well-known way, adjustable by means of a large number of spindles 35 distributed across the machine width. Through the differing actuation of the spindles 35 the profile bar 33 can be deformed within certain limits. In this way the cross sectional profile of the issuing stock jet can be influenced, for example, made more uniform. It has now been found that it is sufficient for the manufacture of a multi-layer paper web to influence only one of the stock jets by means of an adjustable profile bar in the way previously described. In other words: the adjustable profile bar 33 is capable of increasing the uniformity of the cross sectional profile of the entire paper web to such an extent that even a non-uniformity caused by the other stock jet can be compensated for. The adjustable profile bar 33, which is shown only schematically, can be designed in detail in a similar way to DE-PS 29 42 966 (=U.S. Pat. No. 4,326,916).

It can also be seen from FIGS. 1 and 2 that the two side wall sections 17 and 37 extend beyond the slice gap 15 in the direction of flow. It is thereby achieved that the partition wall 16 likewise projecting out ot the slice gap 15 is also held firm laterally outside the nozzle chamber 10 (as far as this is permitted by space).

The two stock jets issuing from the headbox across the width of the machine are introduced, as per FIG. 1, into the wege-shaped inlet nip of a twin wire section. Components of this twin wire section are a wire roll 47, over which one wire belt 7 runs and a forming roll 48, onto which the other wire belt 8 runs (in the direction of the arrow P) shortly ahead of the inlet nip.

In a corresponding way a headbox can also be designed for the production of a fibrous stock web having three or more layers.

We claim:

1. A headbox for the production of fibrous stock webs, comprising:

a nozzle chamber with a slice gap defined by a top lip wall, a bottom lip wall and two side walls, with the top and the bottom lip wall converging in the direction of flow, the nozzle chamber being subdivided for the production of multi-layer fibrous stock webs into at least two machine-wide flow channels by at least one, at least approximately wedge-shaped partition wall which extends in the direction of flow and from one side wall to the other;

the partition wall extending in the direction of flow through the slice gap;

each of the two side walls being subdivided along the partition wall into at least two side wall sections;

the partition wall being clamped at each side wall between and by the side wall sections thereof against displacement relative thereto in the area.

2. A headbox according to claim 1 in which one of the lip walls together with two associated side wall sections comprise an assembly which is swivel-mounted about a substantially horizontal swivel axis which extends substantially perpendicular to the direction of flow.

3. A headbox according to claim 1 in which the partition wall is subdivided into an inlet-side, upstream partition wall section and into an exchangeable outlet-side, downstream partition wall section.

4. A headbox according to claim 3 in which the partition wall sections are detachably connected to one another by a bayonet fixing socket.

5. A headbox according to claim 4 in which the bayonet fixing socket is lockable by means of an expandable tube.

6. A headbox according to claim 1 in which one lip wall at the slice gap carries an exchangeable, rigidly fastened profile bar, and that the other lip wall at the slice gap is fitted with a profile bar adjustable by means of several spindles.

7. A headbox according to claim 1 in which the side wall sections, between which the partition wall is clamped, extend in the direction of flow beyond the slice gap.

8. A headbox according to claim 1 in which a bank of turbulence tubes and a transverse distribution pipe are arranged ahead of each flow channel.

9. A headbox according to claim 8 in which there is arranged a pair of cross walls, one at the inlet-side end of the turbulence tubes and the other at a distance from the outlet-side end of the turbulence tubes, the two cross walls are pierced by the turbulence tubes and are fastened to the lip walls, and the partition wall is fastened to the outlet-side cross wall.

10. A headbox according to claim 2 in which the partition wall is subdivided into an inlet-side, upstream partition wall section and into an exchangeable outlet-side, downstream partition wall section.

11. A headbox according to claim 10 in which the partition wall sections are detachably connected to one another by a bayonet fixing socket.

12. A headbox according to claim 11 in which the bayonet fixing socket is lockable by means of an expandable tube.

13. A headbox according to claim 2 in which one lip wall at the slice gap carries an exchangeable, rigidly fastened profile bar, and that the other lip wall at the slice gap is fitted with a profile bar adjustable by means of several spindles.

14. A headbox according to claim 3 in which one lip wall at the slice gap carries an exchangeable, rigidly fastened profile bar, and that the other lip wall at the slice gap is fitted with a profile bar adjustable by means of several spindles.

15. A headbox according to claim 4 in which one lip wall at the slice gap carries an exchangeable, rigidly fastened profile bar, and that the other lip wall at the slice gap is fitted with a profile bar adjustable by means of several spindles.

16. A headbox according to claim 2 in which the side wall sections, between which the partition wall is clamped, extend in the direction of flow beyond the slice gap.

17. A headbox according to claim 3 in which the side wall sections, between which the partition wall is clamped, extend in the direction of flow beyond the slice gap.

18. A headbox according to claim 4 in which the side wall sections, between which the partition wall is clamped, extend in the direction of flow beyond the slice gap.

19. A headbox according to claim 6 in which the side wall sections, between which the partition wall is clamped, extend in the direction of flow beyond the slice gap.

20. A headbox according to claim 2 in which a bank of turbulence tubes and a transverse distribution pipe are arranged ahead of each flow channel.

21. A headbox according to claim 3 in which a bank of turbulence tubes and a transverse distribution pipe are arranged ahead of each flow channel.

22. A headbox according to claim 4 in which a bank of turbulence tubes and a transverse distribution pipe are arranged ahead of each flow channel.

23. A headbox according to claim 5 in which a bank of turbulence tubes and a transverse distribution pipe are arranged ahead of each flow channel.

24. A headbox according to claim 1 in which there is arranged a pair of cross walls, one at the inlet-side end of the turbulence tubes and the other at a distance from the outlet-side end of the turbulence tubes, the two cross walls are pierced by the turbulence tubes and are fastened to the two lip walls, and the partition wall is fastened to the outlet-side cross wall.

25. A headbox according to claim 2 in which
there is arranged a pair of cross walls, one at the inlet-side end of the turbulence tubes and the other at a distance from the outlet-side end of the turbulence tubes,
the two cross walls are pierced by the turbulence tubes and are fastened to the two lip walls, and
the partition wall is fastened to the outlet-side cross wall.

26. A headbox according to claim 3 in which
there is arranged a pair of cross walls, one at the inlet-side end of the turbulence tubes and the other at a distance from the outlet-side end of the turbulence tubes,
the two cross walls are pierced by the turbulence tubes and are fastened to the two lip walls, and
the partition wall is fastened to the outlet-side cross wall.

27. A headbox according to claim 4 in which
there is arranged a pair of cross walls, one at the inlet-side end of the turbulence tubes and the other at a distance from the outlet-side end of the turbulence tubes,
the two cross walls are pierced by the turbulence tubes and are fastened to the two lip walls, and
the partition wall is fastened to the outlet-side cross wall.

28. A headbox according to claim 6 in which
there is arranged a pair of cross walls, one at the inlet-side end of the turbulence tubes and the other at a distance from the outlet-side end of the turbulence tubes,
the two cross walls are pierced by the turbulence tubes and are fastened to the two lip walls, and
the partition wall is fastened to the outlet-side cross wall.

29. A headbox according to claim 7 in which
there is arranged a pair of cross walls, one at the inlet-side end of the turbulence tubes and the other at a distance from the outlet-side end of the turbulence tubes,
the two cross walls are pierced by the turbulence tubes and are fastened to the two lip walls, and
the partition wall is fastened to the outlet-side cross wall.

* * * * *